US011085161B2

(12) United States Patent
Sun et al.

(10) Patent No.: US 11,085,161 B2
(45) Date of Patent: Aug. 10, 2021

(54) DEVICE AND METHOD FOR TREATING SOFT SOIL FOUNDATIONS

(71) Applicant: ZHEJIANG UNIVERSITY, Hangzhou (CN)

(72) Inventors: Hongyue Sun, Zhoushan (CN); Yuequan Shang, Hangzhou (CN)

(73) Assignee: Zhejiang University, Hangzhou (CN)

( * ) Notice: Subject to any disclaimer, the term of this patent is extended or adjusted under 35 U.S.C. 154(b) by 0 days.

(21) Appl. No.: 16/872,149

(22) Filed: May 11, 2020

(65) Prior Publication Data

US 2021/0156103 A1 May 27, 2021

(30) Foreign Application Priority Data

Nov. 25, 2019 (CN) ..... 201911166488.4

(51) Int. Cl.
*E02D 3/00* (2006.01)
*E02D 3/10* (2006.01)
(Continued)

(52) U.S. Cl.
CPC ..... *E02D 3/10* (2013.01); *E02B 11/005* (2013.01); *E02D 5/72* (2013.01)

(58) Field of Classification Search
CPC ..... E02D 3/10; E02D 5/72; E02B 11/005
See application file for complete search history.

(56) References Cited

U.S. PATENT DOCUMENTS 5,435,666 A * 7/1995 Hassett ..... B09C 1/005 405/128.45
6,254,308 B1 * 7/2001 Cognon ..... E02D 3/10 405/43
(Continued)

FOREIGN PATENT DOCUMENTS

CN 101215833 A 7/2008
CN 101851914 A 10/2010
(Continued)

OTHER PUBLICATIONS

Sun, et al., "Laboratory modeling of siphon drainage combined with surcharge loading consolidation for soft ground treatment", Marine Georesources & Geotechnology, vol. 36, No. 8, 2018, pp. 940-949.
(Continued)

*Primary Examiner* — Carib A Oquendo
(74) *Attorney, Agent, or Firm* — Jingfeng Song; SciNova IP and Regulatory Consulting LLC

(57) ABSTRACT

A device and a method for treating soft soil foundations, the device comprises: a drainage plate (4), a water collection well (7), and a pressurizing drainage pipe (6), the pressurizing drainage pipe (6) is connected to the bottom of the drainage plate and the bottom of the water collection well through pipelines; a pressurizing module comprises: film (12), the film (12) is impermeable and covers the soft soil foundation; a pile-loading body (13), the pile-loading body (13) is arranged on the film; air compressor (1) has a pressurizing end with a space below the film to make a soil layer of the soft soil foundation below the film under an air pressure higher than the atmospheric pressure, so that the underground water discharge process can be started.

8 Claims, 1 Drawing Sheet

(51) Int. Cl.
*E02B 11/00* (2006.01)
*E02D 5/72* (2006.01)

(56) References Cited

U.S. PATENT DOCUMENTS

| | | | | |
|---|---|---|---|---|
| 6,846,130 | B2 * | 1/2005 | Goughnour | E02D 3/10 405/49 |
| 7,607,861 | B2 * | 10/2009 | Kang | E02D 3/10 210/170.01 |
| 10,309,072 | B2 * | 6/2019 | Mei | E02D 3/10 |
| 2007/0127988 | A1 * | 6/2007 | Nakakuma | E02D 3/10 405/36 |
| 2018/0340309 | A1 * | 11/2018 | Fu | E02D 3/12 |

FOREIGN PATENT DOCUMENTS

| | | | |
|---|---|---|---|
| CN | 103628465 | A | 3/2014 |
| CN | 205475195 | U | 8/2016 |
| CN | 206581248 | U | 10/2017 |
| CN | 107842018 | * | 3/2018 |
| EP | 0329500 | * | 8/1989 |

OTHER PUBLICATIONS

Wu, et al., "Consolidation behaviour with and without siphon drainage", Geotechnical Engineering, vol. 171 Issue GE5, Jun. 2018, pp. 462-470.

Wu, et al., "A mathematical model and its solution for unsteady flow under siphon drainage by fully penetrating well in soft ground", Rock and Soil Mechanics, vol. 39, No. 9, Sep. 2018, pp. 3355-3361, 3384.

Machine translation of CN 1st Office Action for Application No. 201911166488.4, dated Aug. 5, 2020, 8 pages.

CN 1st Search Report for Application No. 201911166488.4, dated Aug. 5, 2020, 2 pages.

* cited by examiner

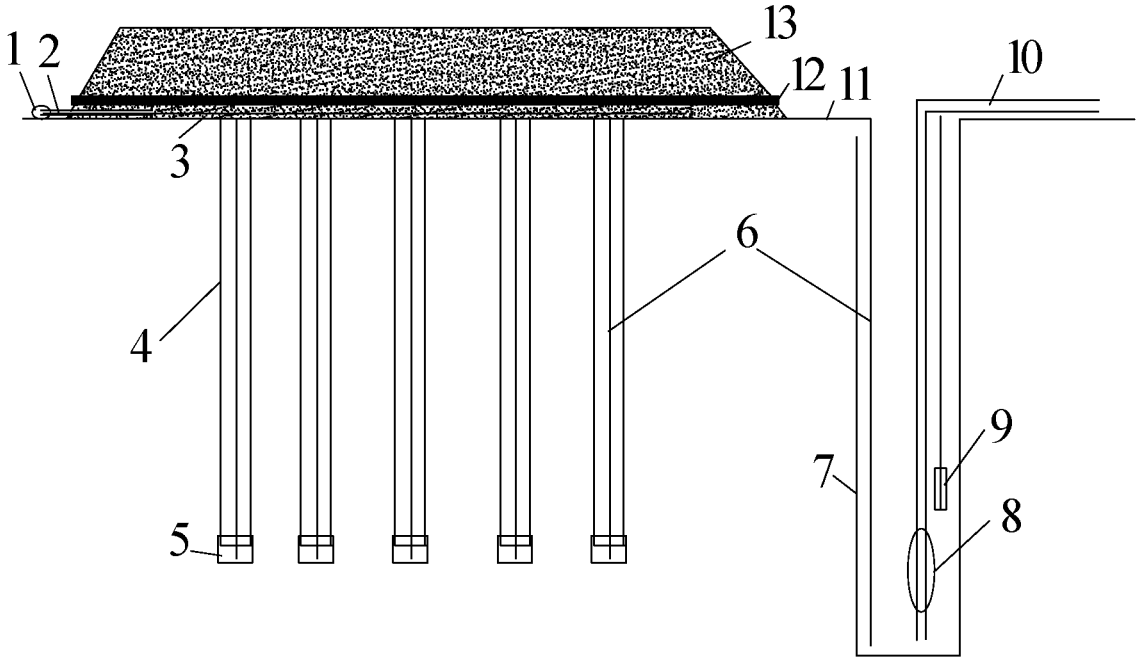
1
2
13
12
11
10
3
6
4
9
7
8
5

DEVICE AND METHOD FOR TREATING SOFT SOIL FOUNDATIONS

CROSS REFERENCE TO RELATED PATENT APPLICATIONS

This application claims priority to Chinese Patent Application No. 201911166488.4, filed on Nov. 25, 2019, entitled "DEVICE AND METHOD FOR TREATING SOFT SOIL FOUNDATIONS", which is hereby incorporated by reference in its entirety.

TECHNICAL FIELD

The invention relates to the technical field of foundation treatment, in particular to a device and method for treating soft soil foundations by means of the change of air pressure.

DESCRIPTION OF RELATED ART

Soft soil is fine-grained soil which is deposited in coasts, lakes, marshes, valleys, and river shoals and has high natural moisture contents, void ratios and compressibility and low shear strength has the characteristics of high natural moisture contents, natural void ratios and compressibility, low shear strength, small consolidation coefficients, long consolidation time, high sensitivity, large disturbances, poor water permeability, complex laminar distributions of soil layers, large difference in physical and mechanical properties of the soil layers, and the like.

Soft soil foundations are generally formed by soft soil layers which have low strength and high compression amounts. The soft soil may cause severe damage to projects such as roads and buildings in most cases due to its low strength and large settlement amounts. Thus, in actual projects, it is necessary to consolidate the soft soil foundations in general.

Currently, methods for treating the soft soil foundations in the industry generally include: a pile preloading method, a vacuum preloading method, a composite foundation treatment method, and the like.

Wherein, according to the pile preloading method, filling loads greater than or equal to design loads are used to promote advanced consolidation settlement of the foundations before project construction to improve the strength of the foundations, so that the post-construction settlement is decreased. After the strength index reaches a value meeting the design requirement, the foundations are unloaded. This method has a mature principle and easy construction and does not need special construction machines and materials. However, this method has a long construction period due to a long drainage consolidation time caused by low consolidation coefficients of the soft soil.

According to the vacuum preloading method, plastic drainage plates are vertically inserted into soil, a sand layer is laid on the plastic drainage plates and is covered with a film to be sealed, air exhaust is carried out to make the plastic drainage plates and the sand layer partially in a vacuum state below the film, a drainage sand mat and a vertical drainage passage are constructed, the vacuum is transmitted from a main drainage pipe, to the sand mat, and finally to the plastic drainage plates to strengthen a soft soil layer. In consideration that the vacuum is transmitted from the main drainage pipe, branched pipes, the sand mat, to the plastic drainage plates, the diversity of transmission paths causes vacuum loss, and consequentially, the vacuum preloading effect is affected. This method does not need to carry out pile loading, omits loading and unloading procedures, shortens the preloading time, saves a large quantity of pile-loading materials, adopts simple devices and construction processes rather than a large quantity of large devices, and is conductive to large-scale construction. However, the method still has a long drainage consolidation time.

The composite foundation treatment method generally refers to other methods for treating soft soil by means of physical and chemical processes to improve the bearing capacity of the soft soil and typically includes a cement-soil mixing pile method, a replacement cushion method, and a grouting method. However, these methods have high costs and are not conductive to large-scale construction.

In order to shorten the preloading time and improve the consolidation effect as far as possible, a direct-discharge vacuum preloading method is put forward in the industry on the basis of a conventional vacuum preloading method. According to the direct-discharge vacuum preloading method, the main drainage pipe is directly connected with the plastic drainage plates through adaptors and the branched pipes, or only a strip sand mat is arranged to wrap a vacuum pipe, so that the vacuum pressure is directly transmitted into the plastic drainage plates by a certain depth via the main drainage pipe, the adaptors, and the branched pipes. In a word, compared with the conventional vacuum preloading method, the direct-discharge vacuum preloading method reduces or omits the sand mat, changes the vacuum transmission path through the direct connection of the vacuum pipe and the drainage plates, reduces the vacuum transmission loss, increases the vacuum pressure in the drainage plates, and saves the cost of the sand mat.

Besides, an over vacuum pressure preloading method has been put forward in recent years. According to the over vacuum pressure preloading method, a pressurization pipe is arranged between every two plastic drainage plates, and after the consolidation degree of soil reaches 30%-50% by means of the conventional vacuum preloading method, the pressurization pipe starts to operate to increase the head pressure of the soil close to the pressurization pipe, the water pressure difference between the soil close to the pressurization pipe and the drainage plates is increased, and free water in the soil is forced to enter the drainage plates, so that the vacuum preloading consolidation effect is improved. However, the over vacuum pressure preloading method lowers the vacuum below the film in the case where pressurization is carried out in the vacuum state below the film, and may generate trapped bubbles in the soil, which is adverse to the drainage effect.

The primary principle of the vacuum preloading method lies in that: the air exhaust is carried out to form the vacuum state below the film to decrease the pressure of pore water in the soil, so that the negative excess pore water pressure is formed in the soil. In a case where a total stress is not increased, the decreased pore water pressure is equivalent to an increased effective stress, so that the soil is consolidated. However, existing vacuum preloading methods still have many shortcomings. In the conventional vacuum preloading method and the direct-discharge vacuum preloading method, an underground water level in the soil is not lowered, and consequentially, the strengthening effects of the foundations are affected. In the over vacuum pressure preloading method, the pressure is difficult to control, and the physical process of pressing air into the soil is an air-water displacement process which may cause potential safety hazards of air explosion resulting from air reserved in the soil.

BRIEF SUMMARY OF THE INVENTION

The objective of the invention is to provide a device and method for treating soft soil foundations on the basis of a new principle.

The invention provides a device for treating soft soil foundations. The device comprises a drainage plate, a water collection well, a pressurizing drainage pipe, a film, a pile-loading body, and an air compressor, wherein the drainage plate is a vertical drainage component which is inserted into a soft soil foundation and has a vertical internal gap and a side pore; the depth of the water collection well is 10-20 m; the pressurizing drainage pipe is connected to the bottom of the drainage plate and the bottom of the water collection well through pipelines; the film is impermeable and covers the soft soil foundation; the pile-loading body is arranged on the film; and the air compressor has a pressurizing end with a space below the film to make a soil layer of the soft soil foundation below the film under an air pressure higher than the atmospheric pressure, so that the underground water discharge process can be started.

In this way, in the whole drainage process, soil is still in a high-pressure state after moisture in the soil is discharged, and the bearing state of the soil layer is not obviously changed, so that the drainage process will not be as slow as the drainage process, accompanied with soil consolidation, of a vacuum preloading method. After the air compressor stops operating, the high-pressure state is eliminated, and the weight of the pile-loading body acts on foundation soil having underground water discharged, so that the compression and consolidation process of the foundation soil without the underground water can be completed rapidly.

In one embodiment, a pressurization module is composed of the film, the pile-loading body, an air compression mechanism, and an air-permeable layer which is arranged above the soft soil foundation and located below the film.

The air-permeable layer can protect a drainage facility, has good air permeability, and further has an effect of protecting the intactness of the film in contact with the air-permeable layer.

In one embodiment, one end, inserted into the soft soil foundation, of the drainage plate is provided with a pile shoe.

In one embodiment, one end of the pressurizing drainage pipe is communicated with a water accommodating space in the pile shoe.

In one embodiment, the depth of the drainage plate inserted into the soft soil foundation is at least the altitude of a water column corresponding to air pressure below the film.

The invention further provides a method for treating soft soil foundations. According to the device for treating soft soil foundations in any one of the above embodiments, the method comprises the following steps:

S1: arranging a water collection well, a drainage plate, and a pressurizing drainage pipe in a soft soil foundation to be treated;

S2: arranging a pressurization module which at least includes an air compressor, a film, and a pile-loading body on the soft soil foundation to be treated; and S3: starting the air compressor to make a soil layer of the soft soil foundation below the film under an air pressure higher than the atmospheric pressure so as to start the underground water discharge process.

In one embodiment, the method further comprises:

S4: after the drainage process is finished, stopping the operation of the air compressor to make the pile-loading body compress the unsaturated soft soil foundation to complete soil consolidation.

In one embodiment, in the underground water discharge process, the maximum air pressure below the film is kept in balance with the weight of the pile-loading body.

BRIEF DESCRIPTION OF THE SEVERAL VIEWS OF THE DRAWINGS

FIG. 1 is a schematic diagram of a device for treating soft soil foundations.

DETAILED DESCRIPTION OF THE INVENTION

For a better understanding of the technical issues to be settled, technical solutions, and advantages of the invention, the invention is expounded below in combination with the accompanying drawings and specific embodiments. In the following description, specific configurations and characteristic details of components are only provided to assist in a comprehensive understanding of the embodiments of the invention. Thus, those skilled in the art can make various changes and modifications on the following embodiments without deviating from the scope and spirit of the invention. Besides, for the sake of a clear and brief description, the descriptions on known functions and structures are omitted.

It should be understood that "one embodiment" or "an embodiment" mentioned throughout the specification means that specific characteristics, structures, or properties related to the embodiment are included in at least one embodiment of the invention. Thus, "in one embodiment" or "in an embodiment" throughout the whole specification does not necessarily refer to the same embodiment. Besides, these specific characteristics, structures, or properties can be arbitrarily combined in one or more embodiments.

In all embodiments of the invention, it should be understood that the sequence numbers of the following processes do not mean the execution order. The execution order of the processes should be determined by the functions and internal logic of the processes, and should not limit any implementation processes of the embodiments of invention.

It should be understood that the term "and/or" in this article is only an association relationship for describing associated objects and indicates that there are three relationships. For instance, A and/or B indicates that A exists independently, A and B exist simultaneously, and B exists independently. Besides, the character "/" in this article generally indicates that the associated objects are in an "or" relationship.

In the embodiments of this application, it should be understood that "B corresponding to A" indicates that B is associated with A, and B can be determined according to A. It should be further understood that B is not only determined according to A, but also determined according to A and/or other information.

Embodiments

The invention particularly relates to a device and method for treating soft soil foundations.

As shown in FIG. 1, the device for treating soft soil foundations comprises an air compressor 1, an air inflation pipe 2, an air-permeable layer 3, drainage plates 4, pile shoes 5, a pressurizing drainage pipe 6, a water collection well 7, a water pump 8, a water level controller 9, a drainage pipe 10, a ground 11, a film 12, a pile-loading body 13, and other operating modules.

The operating modules are respectively expounded as follows:

Drainage Plate

The drainage plates are vertical drainage components which are inserted into a soft soil foundation and have vertical internal gaps and side pores to facilitate water in soil to enter the drainage plates. Although the drainage plates in the invention are described as drainage plate in consideration of a common name in the industry, it should be understood that drainage components having vertical and side drainage passages can be used as equivalent replacements of the drainage plates of the invention.

A typical drainage plate 4 may be a common plastic drainage plate in projects. In order to improve drainage efficiency and easily insert the drainage plates into the soil, the pile shoes 5 are arranged at one ends of the drainage plates 4.

The distribution principle of the drainage plates is generally based on the area of a soft soil foundation to be treated, and the plastic drainage plates are distributed on the same plane in different spaced and arrayed manners. It should be understood that in spite of various planar arrangement manners, the plastic drainage plates 4 should be reasonably arranged based on the drainage radiuses of the plastic drainage plates 4.

The depth of the drainage plates inserted into the soil is determined according to the treatment needs of the foundation. However, the depth of the drainage plates inserted into the soft soil foundation is at least the altitude of a water column corresponding to the air pressure below the film.

In an illustrative embodiment of the invention, the insertion depth of the plastic drainage plates is 15 m, and the planar spacing of the plastic drainage plates is 2 m.

Pressurizing Drainage Pipe

The pressurizing drainage pipe 6 is communicated with the bottoms of the drainage plates 4 and the bottom of the water collection well 7 (which will be expounded hereinbelow). Typically, the pressurizing drainage pipe 6 is a slim pipe having a diameter of 5 mm and has one end extending into the pile shoes 5 via the insides of the drainage plates 4 and the other end extending to the bottom of the water collection well 7.

Typically, water accommodating spaces are configured in the pile shoes 5 and are communicated with the bottom of the water collection well 7 through one end of the pressurizing drainage pipe 6.

The pressurizing drainage pipe 6 allowing a plurality of drainage plates 4 to be collected is converged into the water collection well 7 through a pipe network.

Water Collection Well

The water collection well 7 is arranged close to the soft soil foundation to be treated. Typically, the water collection well 7 is formed in a drilling manner and/or a manual hole digging manner.

Furthermore, a facility for discharging water to the outside is arranged at the bottom of the water collection well 7. Typically, the facility is a drainage facility provided with the water pump 8 and the drainage pipe 10 connected with the water pump 8. Underground water in the water collection well 7 is discharged by the drainage facility out of the soft soil foundation to be treated.

Furthermore, the drainage facility further includes the water level controller 9 used for detecting and controlling the preset depth of the underground water level in the water collection well 7, and the preset depth is generally used for determining start and stop conditions of the water pump.

For instance, the preset depth is a preset range value. When the underground water level in the water collection well 7 exceeds the upper limit of the preset value, the water level controller 9 controls the drainage facility to operate to lower the underground water level in the water collection well 7 to the lower limit of the preset value, and then controls the drainage facility to stop drainage operation.

In the illustrative embodiment of the invention, the depth of the water collection well 7 is 15 m.

Pressurization Module

The pressurization module is used for pressurizing underground water in the soft soil foundation to make the underground water in the soft soil foundation be discharged into the water collection well 7 via the pressurizing drainage pipe 6 under a high pressure.

The pressurization module includes the air-permeable layer 3, the film 12, the air compressor 1, and the pile-loading body 13.

Wherein, the air-permeable layer is arranged on the ground 11, having the drainage plates 4 inserted therein and a pressurizing drainage pipe network laid thereon, of the soft soil foundation. Typically, the air-permeable layer 3 is a sand mat which can protect the drainage facility and has good air permeability. The air-permeable layer 3 further has an effect of protecting the intactness of the film 12 in contact with the air-permeable layer.

The film 12 covers the soft soil foundation to guarantee the air impermeability of the soft soil foundation to be treated against the outside.

The air compressor 1 has a pressurizing end communicated with the air-permeable layer 3 and carries out pressurization below the film 12 after being started.

The pile-loading body 13 is uniformly arranged on the film 12. After the air compressor 1 is started, the air pressure below the air-proof film 12 is increased, and the weight of the pile-loading body is borne by the film, so that the maximum air pressure below the film is kept in balance with the weight of the pile-loading body 13. Typically, in the illustrative embodiment of the invention, a thick soil layer of 2 m is adopted as the pile-loading body 13.

In this way, in the operating state of the air compressor 1, the drainage plates 4 and the air-permeable layer 3 below the air-proof film 12 are under an air pressure higher than the atmospheric pressure, the pressure of pore water in a soil layer of the soft soil foundation is increased, and the underground water is forced to flow into the water collection well 7 via the pressurizing drainage pipe 6, so that the drainage is started; and the underground water in the soft soil foundation continuously flows into the water collection well 7 via the pressurizing drainage pipe and is discharged by the drainage facility. When the underground water level is lowered to meet the design requirement, the air compressor stops operating, and at this moment, the soil is unsaturated, so that the compression and consolidation process of the soil can be rapidly completed under the effect of the pile-loading body 13.

That is, in the whole drainage process, the soil is still in a high-pressure state after moisture in the soil is discharged, and the bearing state of the soil layer is not obviously changed, so that the drainage process will not be as slow as the drainage process, accompanied with soil consolidation, of a vacuum preloading method. After the air compressor stops operating, the high-pressure state is eliminated, and the weight of the pile-loading body 13 acts on foundation soil having the underground water discharged, so that the pressurization and compression process of the unsaturated foundation soil can be completed rapidly.

That is, in the device for treating soft soil foundations of the invention, the drainage process and the compressive deformation and consolidation process of the soil are mutually independent.

The method for treating soft soil foundations is further expounded below and comprises:

S1: drainage plates 4, a water collection well 7, and a pressurizing drainage pipe 6 are arranged in a soft soil foundation to be treated;

S2: a pressurization module which at least includes an air compressor 1, a film 12, and a pile-loading body 13 is arranged on the soft soil foundation to be treated; and S3: the air compressor 1 is started to make a soil layer of the soft soil foundation below the film 12 under an air pressure higher than the atmospheric pressure so as to start drainage.

Furthermore, the method further comprises:

S4: after the drainage is finished, the air compressor 1 stops operating to make the pile-loading body 13 compress the unsaturated soft soil foundation to complete soil consolidation.

Furthermore, the pressurization module further includes an air-permeable layer arranged on a ground 11.

It should be finally noted that the above embodiments are only used for explaining the technical solutions of the invention instead of limiting the technical solutions of the invention. Although the invention is expounded with reference to the above embodiments, those skilled in the art can still make modifications on the technical solutions recorded in the above embodiments or equivalent replacements on partial technical features of the technical solutions without causing the deviation of the essence of the corresponding technical solution from the spirit and scope of the technical solutions of the embodiments of the invention.

What is claimed is:

1. A device for treating soft soil foundations comprising:

a drainage plate, which is vertically inserted into a soft soil foundation and has a vertical internal gap and a side pore;

a water collection well with a depth from 10 to 20 meters, wherein the level of its bottom is lower than the lowest position of the drainage plate;

a pressurizing drainage pipe, which is connected to the bottom of the drainage plate and the bottom of the water collection well through pipelines; and a pressurizing module comprising:

a film, which is impermeable and covers the soft soil foundation;

a pile-loading body, which is arranged on the film;

an air-permeable layer between the film and the soft soil foundation;

a space between the film and the air-permeable layer, wherein an air pressure is constantly maintained at a level higher than the atmospheric pressure; and an air compressor, which has a pressurizing end inserted to the space below the film.

2. The device for treating soft soil foundations according to claim 1, wherein one end inserted into the soft soil foundation of the drainage plate is provided with a pile shoe.

3. The device for treating soft soil foundations according to claim 2, wherein one end of the pressuring drainage pipe is communicated with a water accommodating space in the pile shoe.

4. The device for treating soft soil foundations according to claim 1, wherein a depth of the drainage plate inserted into the soft soil foundation is at least the altitude of a water column corresponding to air pressure below the film.

5. The device for treating soft soil foundations according to claim 4, wherein the depth of the drainage plate inserted into the soft soil foundation is 15 meters.

6. A method for treating soft soil foundations with a device, the device comprising:

a drainage plate, which is vertically inserted into a soft soil foundation and has a vertical internal gap and a side pore;

a water collection well with a depth from 10 to 20 meters, wherein the level of its bottom is lower than the lowest position of the drainage plate;

a pressurizing drainage pipe, which is connected to the bottom of the drainage plate and the bottom of the water collection well through pipelines; and a pressurizing module comprising:

a film, which is impermeable and covers the soft soil foundation;

a pile-loading body, which is arranged on the film;

an air-permeable layer between the film and the soft soil foundation;

a space between the film and the air-permeable layer, wherein an air pressure is constantly maintained at a level higher than the atmospheric pressure; and an air compressor, which has a pressurizing end inserted to the space below the film;

the method comprising the following steps:

arranging the drainage plate, the water collection well, and the pressurizing drainage pipe in the soft soil foundation to be treated;

arranging a pressurizing module on the soft soil foundation to be treated; and starting the air compressor to make the space below the film under an air pressure higher than the atmospheric pressure so as to start the underground water discharge process, wherein a weight of the pile-loading body is borne by the film and a maximum air pressure below the film is kept in balance with the weight of the pile-loading body.

7. The method according to claim 6, wherein the method further comprises:

After the drainage process is finished, stopping the operation of the air compressor to make the pile-loading body compress the unsaturated soft soil foundation to complete soil consolidation.

8. The method according to claim 6, wherein a thick soil layer of 2 meters is adopted as the pile-loading body.

* * * * *